US008942593B2

(12) United States Patent
Thompson

(10) Patent No.: US 8,942,593 B2
(45) Date of Patent: Jan. 27, 2015

(54) METHOD OF REMOVING THE IMAGING DRUM OF A LASER AND PRINTER IMAGING CARTRIDGE

(75) Inventor: Jeremy Peter Thompson, Somerset (GB)

(73) Assignee: PBT International Limited, Somerset (GB)

( * ) Notice: Subject to any disclaimer, the term of this patent is extended or adjusted under 35 U.S.C. 154(b) by 1147 days.

(21) Appl. No.: 12/739,450

(22) PCT Filed: Oct. 21, 2008

(86) PCT No.: PCT/GB2008/003556

§ 371 (c)(1), (2), (4) Date: Oct. 27, 2010

(87) PCT Pub. No.: WO2009/053680

PCT Pub. Date: Apr. 30, 2009

(65) Prior Publication Data

US 2011/0038648 A1 Feb. 17, 2011

(30) Foreign Application Priority Data

Oct. 25, 2007 (GB) ..... 0721070.1

(51) Int. Cl.

| | |
|---|---|
| ***G03G 15/02*** | (2006.01) |
| ***G03G 21/16*** | (2006.01) |
| ***G03G 21/18*** | (2006.01) |
| ***G03G 15/00*** | (2006.01) |

(52) U.S. Cl.

CPC ..... *G03G 21/181* (2013.01); *G03G 15/751* (2013.01); *G03G 2215/00987* (2013.01)

USPC ..... 399/116; 399/111

(58) Field of Classification Search

USPC ..... 399/107, 110, 111, 116, 117

See application file for complete search history.

(56) References Cited

U.S. PATENT DOCUMENTS

| | | | | |
|---|---|---|---|---|
| 2005/0098003 | A1* | 5/2005 | Kramer | 82/1.11 |
| 2007/0025759 | A1 | 2/2007 | William et al. | |
| 2007/0269232 | A1 | 11/2007 | Davison et al. | |
| 2008/0112724 | A1 | 5/2008 | Ohanyan | |

OTHER PUBLICATIONS

PCT Search Report dated Feb. 11, 2009 of Patent Application No. PCT/GB2008/003556 filed Oct. 21, 2008.

* cited by examiner

*Primary Examiner* — Joseph S Wong

(74) *Attorney, Agent, or Firm* — Maine Cernota & Rardin

(57) ABSTRACT

A method of removing the imaging drum (2) of a desktop laser printer and the like wherein pressure is applied to either one or both of the stub bearings (5) of the imaging drum mounted in support bearings (7) attached to the body of the printer cartridge to dislodge the stub bearings and thereafter the application of pressure is continued to force the stub bearings out of their support bearings to allow the drum to be released. This avoids the disadvantages of present known methods one of which involves sawing through the imaging drum and then sliding the two cut halves out of their respective bearings in the printer cartridge.

9 Claims, 1 Drawing Sheet

METHOD OF REMOVING THE IMAGING DRUM OF A LASER AND PRINTER IMAGING CARTRIDGE

RELATED APPLICATIONS

This application is a national phase application filed under 35 USC §371 of PCT Application No. PCT/GB2008/003556 with an International filing date of Oct. 21, 2008 which claims priority of GB Patent Application 0721070.1 filed Oct. 25, 2007. Each of these applications is herein incorporated by reference in their entirety for all purposes.

FIELD OF THE INVENTION

The present invention relates to desk top laser printer, LCD printer imaging cartridges, copier cartridges and multifunction device cartridges particularly to removal of the imaging drum of such cartridges to enable the imaging cartridge to be recycled.

BACKGROUND OF THE INVENTION

A significant proportion of desktop laser printer, LCD printer imaging cartridges, copier cartridges and multi function device cartridges are recycled. The remanufacturing process involves renewal of key components such as the imaging drum which consequently has to be dismantled from the cartridge.

Conventional methods of removing the imaging drum involve dismantling the end support members of the cartridge carrying the drum so that the drum may be removed and replaced easily without damage to the cartridge. The dismantling procedure usually involves unclipping and/or unscrewing certain support members in order to free the imaging drum.

Some imaging cartridge end support members for the imaging drum however are welded or otherwise integrally formed together such that the imaging drum cannot be easily removed without damaging the cartridge. One such group of imaging cartridges manufactured in this way is the Hewlett Packard 2600 colour cartridge set comprising of similar cartridges containing different colour fonts.

In this cartridge type the end support members for the imaging drum are welded in place by a adhesive or by a heat inducing process and removal of the imaging drum mounted in the support members can be both difficult and time consuming.

The most common methods of removal in cases like this involve a cutting procedure applied to the used imaging drum while assembled in situ. One such method recommended by Static Control Corporation, a supplier of equipment for use in imaging drum removal, involves sawing through the imaging drum assembly with a fine saw and then sliding the two halves out of their respective bearing housings. United States Patent 20070025759 assigned to Static Control Corporation describes this cutting method.

During this process harmful swarf is created which must thereafter be meticulously removed.

Another removal process described by Future Graphics Corporation uses a special drill and proprietary cutting device. The cutting device is pushed through a drilled hole in the support assembly and is then spun to cut through the drum assembly from within to form two halves which are then removed. In the process swarf is again created and must be removed very carefully or it will interfere with the development process when the cartridge is remanufactured.

As mentioned during the above described removal operation, it is possible for an operator to actually damage the cartridge which must be avoided at all costs.

SUMMARY OF THE INVENTION

It is an object of the invention to obviate the disadvantages of the prior known methods for dismantling the imaging drum from imaging cartridges where the drum is held to the cartridge in such a way as to necessitate removal by means other than undoable clips and screws.

According to the invention there is provided a method of removing the imaging drum of a desktop laser printer and LCD printer or copier or multifunction device cartridge, the imaging drum having mounting stub bearings at either end positioned respectively in support bearings attached to the body of the printer cartridge, the method comprising the steps of applying pressure to either one or both of the stub bearings in an axial direction with respect to the cartridge drum to dislodge one or both of the stub bearings from their normal position, and continuing to apply said pressure to force the stub bearing(s) into the interior of the drum and out of the cartridge support bearing(s) thereby to allow the drum to be released from the cartridge.

Other features and advantages of the present invention become apparent from the following description of a preferred embodiment taken with reference to the accompanying drawings.

DETAILED DESCRIPTION

Figure 1:
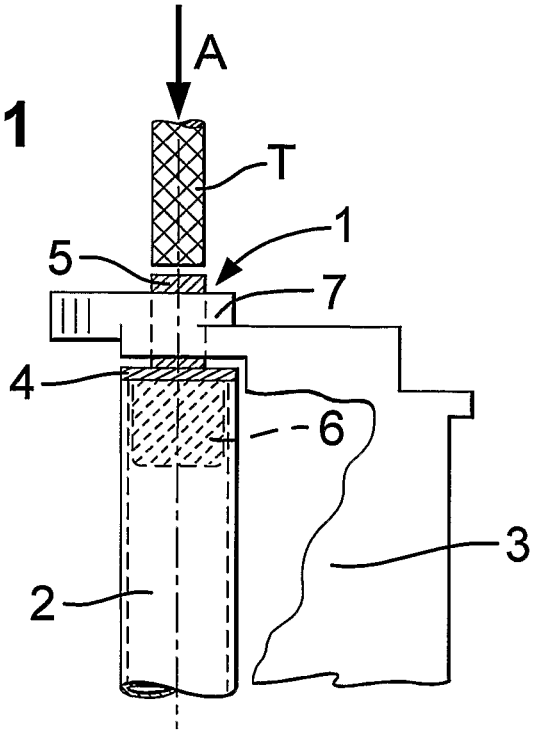
FIG. 1 depicts in part sectional detail the manner in which the imaging drum is mounted to the cartridge of a Hewlett Packard 2600.

In the drawings one end 1 of the imaging drum 2 of an Hewlett Packard 2600 imaging cartridge 3 is shown installed in position as it is received from the factory.

Each end 1 of the imaging drum 2 is provided with a drum positioning shoulder member 4 with an end bearing stub shaft 5 of smaller diameter extending from the shoulder member 4 and an internal bearing section 6 having a diameter to match the internal diameter of the imaging drum 2.

The axial end bearing stub shaft 5 is mounted in a hollow bearing housing 7 which in the particular imaging cartridge 3 illustrated is integrally formed with the body of the cartridge.

As referred to earlier in the disclosure, one of the most common methods employed in the removal of the imaging drum 2 involves cutting through the imaging drum 2 to enable the two separated parts of the drum 2 to be slid out of the bearing housings 7. It will be appreciated that this is a messy and time consuming procedure with attendant possibilities of causing damage to the cartridge body.

With the various embodiments of the present invention a wholly new approach has been adopted and that is to focus attention on the end bearing parts 4, 5, 6 of the imaging drum 2 and to separate these bearing parts from the imaging drum itself without involving the use of saws or other cutting devices which of necessity produce swarf which has to be removed carefully to avoid interference with the development process when the cartridge is remanufactured.

To do this pressure is applied by a removal tool T to the end of the exteriorly extending bearing stub shaft 5 of the drum in a direction inwardly and axially of the imaging drum as shown by the arrow A.

Figure 2:
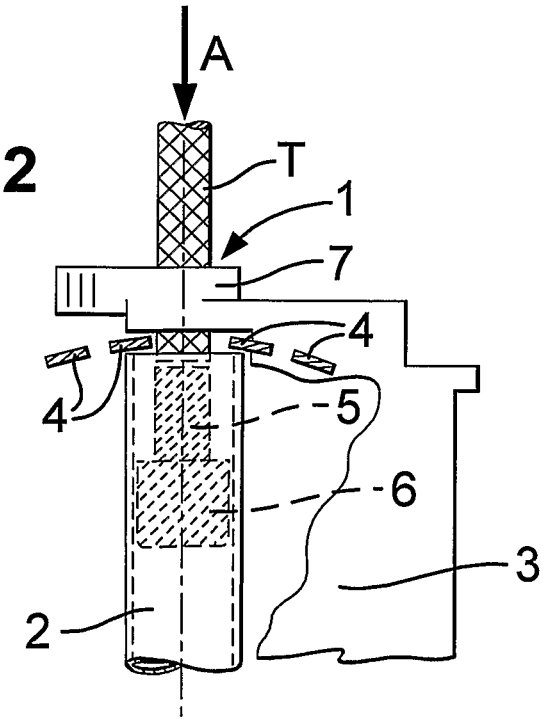
FIG. 2 depicts in part sectional detail the application of means applied to the shoulder bearings of the imaging drum of the cartridge shown in FIG. 1 to enable removal of the imaging drum.

This has the effect of breaking the drum positioning shoulder member 4 of the drum end bearing so that upon the application of further pressure in the same direction the remaining parts 5, 6 of the end bearing see FIG. 2, are pushed within the body of the imaging drum 2.

The advantageous results of this method according to various embodiments of the invention are remarkable compared to the methods employed in the prior art.

First of all it is fast and can be accomplished in just a few seconds.

It creates no resultant dust or swarf, and very importantly it does not damage the cartridge casing as occurs with prior art methods.

The necessary pressure to be applied to the end bearing stub shaft 5 of the end bearings of the imaging drum 2 may be accomplished by a variety of means as will be apparent to those skilled in the art.

One embodiment of the present invention is to apply the pressure by means of a press which may be hand, foot or power operated.

To facilitate the speed of removal a simple support jig may be employed to retain the cartridge during removal of the imaging drum and a guiding jig to centre the pressure tool against the end bearings to ensure uniformity of application of pressure forces.

The breaking pressure may be applied to one or both of the bearing shafts 5 of the imaging drum. In the Hewlett Packard 2600 cartridge pressure is most effectively applied to the drive gear end of the imaging drum as shown in the drawings.

Once removed from the cartridge 3, the imaging drum 2 may be discarded for recycling and a replacement unit fitted without need for further alteration of modification to the cartridge.

The invention claimed is:

1. A method of removing the imaging drum of a desktop laser printer and LCD printer or copier or multifunction device cartridge, the imaging drum having a main casing defining a drum interior, stub bearings attached to the casing at either end thereof positioned respectively in support bearings attached to the body of the cartridge, the method comprising the steps of applying pressure to either one or both of the stub bearings in an axial direction with respect to the imaging drum to dislodge one or both of the stub bearings from their normal position, and continuing to apply said pressure to force the stub bearing(s) bodily intact into the drum interior main casing which otherwise remains intact, and out of the support bearing(s) thereby to allow the main casing as a whole with the stub bearings there inside to be released from the cartridge.

2. The method as claimed in claim 1 wherein pressing and forcing is by means of a pressing or impact device.

3. The method as claimed in claim 1 whereby the pressing or the impact device is screw operated.

4. The method as claimed in claim 2 wherein the pressing or impact device is powered by compressed air or gas.

5. The method as claimed in claim 2 wherein the pressing or impact device is powered or operated by hydraulic means.

6. The method as claimed in claim 2 wherein the pressing or impact device is powered or operated by electrical means.

7. The method as claimed in claim 2 wherein the pressing or impact device is a type of hammer device.

8. The method as claimed in claim 1 wherein the imaging cartridge is held in place by means of a jig to enable pressure to be applied to one or both of the mounting bearings of the imaging drum.

9. The method as claimed in claim 1 wherein the pressure is applied by means of a tool designed to locate the point of pressure to be applied to the mounting bearings to force the mounting bearings into the interior of the imaging drum to facilitate removal thereof from the cartridge.

* * * * *